US007062869B1

(12) United States Patent
Pilcher et al.

(10) Patent No.: US 7,062,869 B1
(45) Date of Patent: Jun. 20, 2006

(54) QUICK STARCH SPRAY IRON

(76) Inventors: Lucy Pilcher, 8042 S. Calumet Ave., Chicago, IL (US) 60619; Kathy Lynneu Pilcher, 8042 S. Calumet Ave., Chicago, IL (US) 60619

( * ) Notice: Subject to any disclaimer, the term of this patent is extended or adjusted under 35 U.S.C. 154(b) by 3 days.

(21) Appl. No.: 10/987,350

(22) Filed: Nov. 12, 2004

Related U.S. Application Data

(60) Provisional application No. 60/523,148, filed on Nov. 19, 2003.

(51) Int. Cl.
*D06F 75/22* (2006.01)

(52) U.S. Cl. ..... 38/77.5; 38/77.82

(58) Field of Classification Search ..... 38/77.1, 38/77.2, 77.5, 77.82, 79, 88, 90, 93, 95; 219/246, 219/259; 210/94, 95, 253

See application file for complete search history.

(56) References Cited

U.S. PATENT DOCUMENTS

| | | | | | |
|---|---|---|---|---|---|
| 1,892,792 | A | * | 1/1933 | Thompson | 38/77.1 |
| 2,817,169 | A | * | 12/1957 | Schott | 38/77.1 |
| 3,224,122 | A | * | 12/1965 | Jepson et al. | 38/77.2 |
| 3,685,180 | A | | 8/1972 | Davidson | |
| 3,949,499 | A | * | 4/1976 | Schaeffer et al. | 38/77.3 |
| 4,115,935 | A | * | 9/1978 | Toft | 38/88 |
| 4,398,364 | A | * | 8/1983 | Augustine et al. | 38/77.5 |
| 5,526,595 | A | * | 6/1996 | Daulasim et al. | 38/77.8 |
| 5,787,614 | A | * | 8/1998 | Stutzer | 38/77.1 |
| 6,035,563 | A | | 3/2000 | Hoefer | |
| 6,351,901 | B1 | | 3/2002 | Amsel | |

* cited by examiner

*Primary Examiner*—Ismael Izaguirre

(57) ABSTRACT

A household apparatus for use in conjunction with clothing. The apparatus is an iron that has two separate compartments for liquid rather than just one compartment. One of the compartments is for water, while the other compartment is for a water/starch combination. Each compartment has its own separate dispersing mechanism that allows an individual to independently add water, starch, or both to a particular item of clothing being ironed.

11 Claims, 3 Drawing Sheets

QUICK STARCH SPRAY IRON

I. CROSS-REFERENCE TO RELATED APPLICATIONS

This application claims the benefit of U.S. Provisional Application No. 60/523,148, filed Nov. 19, 2003.

II. BACKGROUND OF THE INVENTION

The present invention concerns that of a new and improved household apparatus for use in conjunction with clothing.

III. DESCRIPTION OF THE PRIOR ART

U.S. Pat. No. 6,351,901, issued to Amsel, discloses a steam iron with means to add starch to the steam.

U.S. Pat. No. 6,035,563, issued to Hoefer, discloses an electric iron with means for spraying a suitable additive such as starch.

U.S. Pat. No. 3,685,180, issued to Davidson, discloses an iron with means to spray an adjustable stream of starch.

IV. SUMMARY OF THE INVENTION

The present invention concerns that of a new and improved household apparatus for use in conjunction with clothing. The apparatus is an iron that has two separate compartments for liquid rather than just one compartment. One of the compartments is for water, while the other compartment is for a water/starch combination. Each compartment has its own separate dispersing mechanism that allows an individual to independently add water, starch, or both to a particular item of clothing being ironed.

There has thus been outlined, rather broadly, the more important features of an iron that the detailed description thereof that follows may be better understood and in order that the present contribution to the art may be better appreciated. There are, of course, additional features of the iron that will be described hereinafter and which will form the subject matter of the claims appended hereto.

In this respect, before explaining at least one embodiment of the iron in detail, it is to be understood that the iron is not limited in its application to the details of construction and to the arrangements of the components set forth in the following description or illustrated in the drawings. The iron is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present iron. It is important, therefore, that the claims be regarded as including such equivalent constructions insofar as they do not depart from the spirit and scope of the present invention.

It is therefore an object of the present invention to provide an iron which has all of the advantages of the prior art and none of the disadvantages.

It is another object of the present invention to provide an iron which may be easily and efficiently manufactured and marketed.

It is another object of the present invention to provide an iron which is of durable and reliable construction.

It is yet another object of the present invention to provide an iron which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
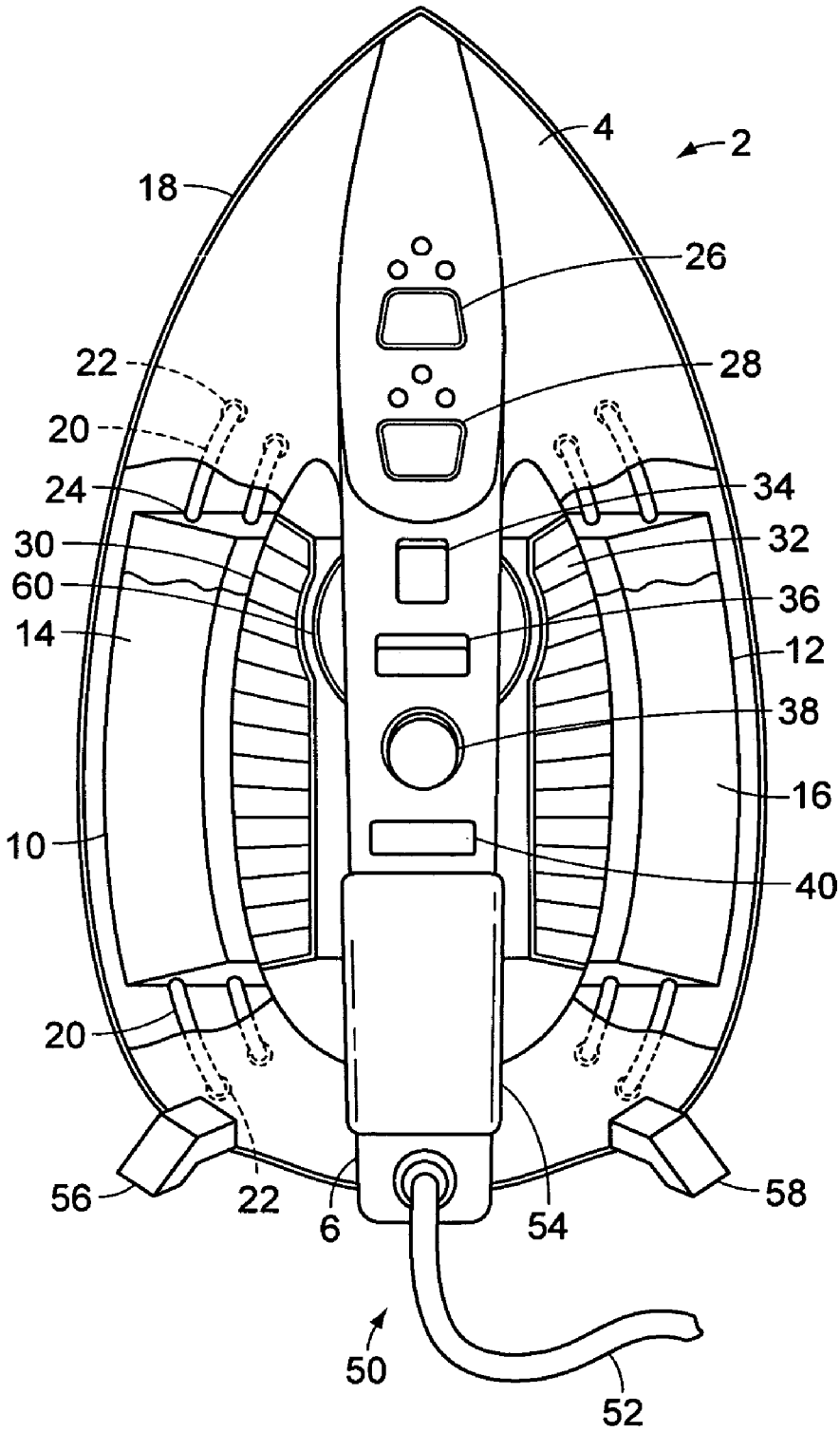
FIG. 1 shows a front view cutaway view of the iron.
Figure 2:
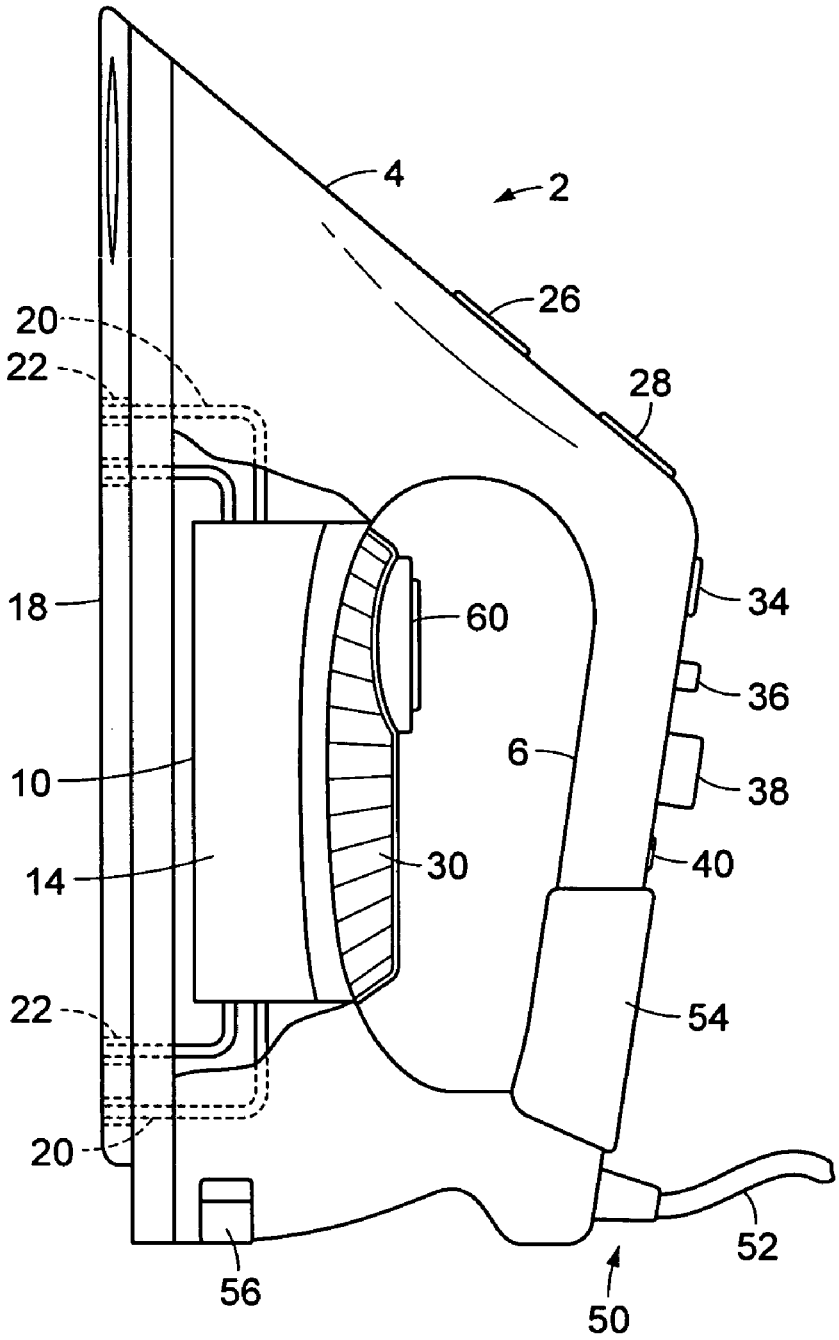
FIG. 2 shows a side view cutaway view of the iron.

FIG. 1 shows a front view cutaway view of the iron 2, while FIG. 2 shows a side view cutaway view of the iron 2. Iron 2 is an improvement over existing irons that are available today due to extra features incorporated into the iron.

Iron 2 has main body 4, which has two ends, a top end and a bottom end, and two sides, a front side and a rear side. Handle 6 has two ends, a top end and a bottom end, with the top end of handle 6 attached to the top end of main body 4 and the bottom end of handle 6 attached to the bottom end of main body 4. A user can grab the middle of handle 6 for support of the iron 2 when using the iron 2.

Iron 2 has two inner compartments, which can best be seen in FIG. 1 as resting side by side to one another. Water compartment 10 is shown as being on the left, while starch compartment 12 is shown as being on the right. These representations are not meant to be exclusive, as the location of the two compartments could easily be switched. Water compartment 10 includes a volume of water 14 within it, while starch compartment 12 includes a volume of water 16 that has starch mixed in with it. Compartments 10 and 12 are located behind face plate 18, which is attached to the front side of the main body 4.

Compartments 10 and 12 each have a plurality of output tubes 20 which connect up to a plurality of exit holes 22, with the exit holes 22 being located on the face plate 18 of the iron 2. Each of the output tubes has two ends, a first end and a second end, with the first end of each tube being attached to a compartment and the second end of each tube located on the face plate 18 of the iron 2. A pressure valve 24 exists within each output tube 20 at the location where each output tube 20 connects to the compartment 10 or compartment 12.

Figure 3:
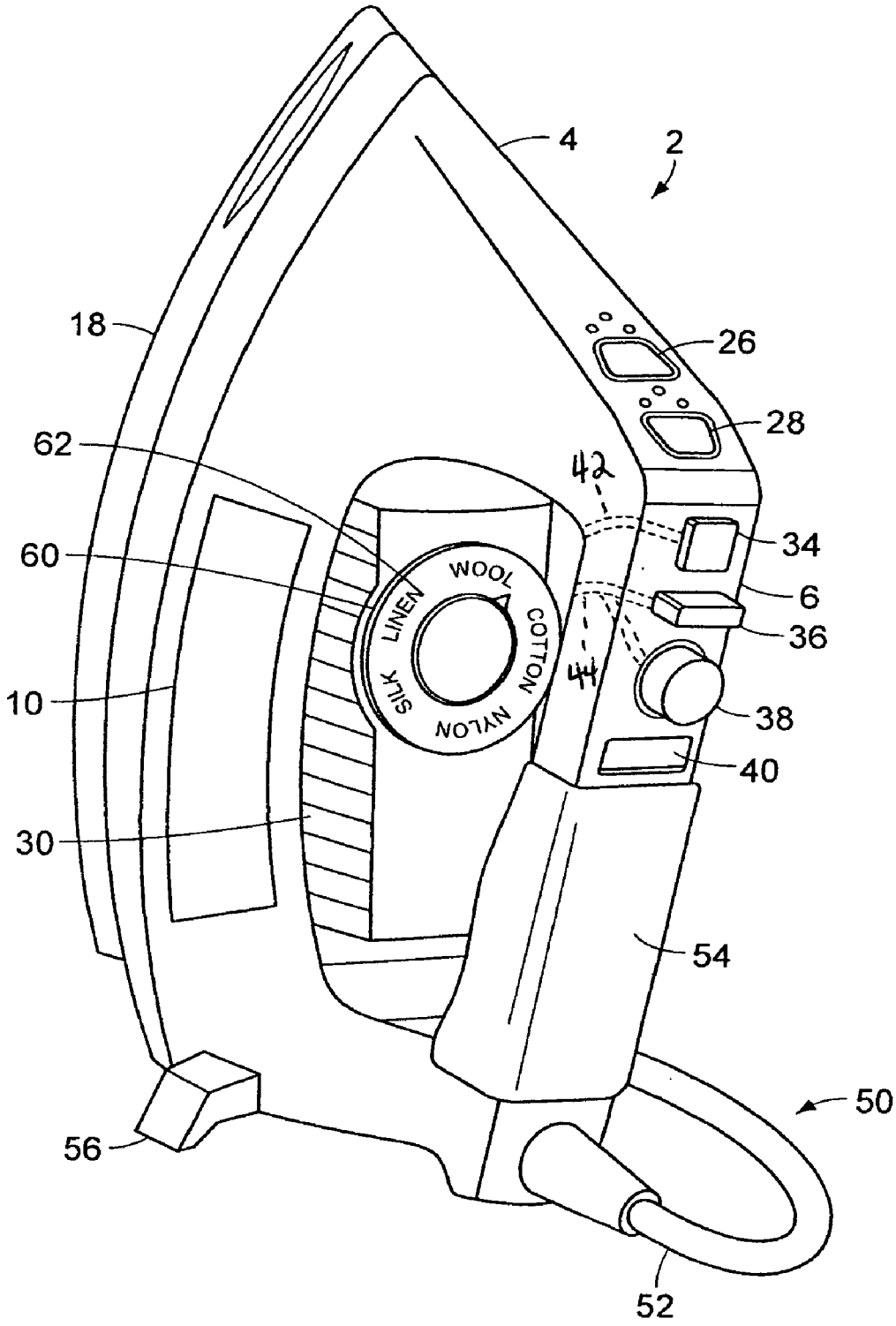
FIG. 3 shows a perspective view of the iron.

FIG. 3 shows a perspective view of the iron 2. Iron 2 has a water reservoir inlet 26 and a starch reservoir inlet 28 on the top end of the main body 4. A user would be allowed to put extra water or starch-water solution, respectively, into the water reservoir inlet 26 and a starch reservoir inlet 28, as the need may arise. As can be seen from FIG. 3, the side of compartment 10 has a water level indicator 30, which allows the side of compartment 10 to be visible to allow an individual to see the level of water within the compartment 10. Such a setup is also present on the other side of the main body 4 of the iron 2 to allow an individual to see the level of the starch-water combination in the compartment 12, with that side of the iron having starch level indicator 32.

The top end of the handle 6 of the iron 2 has a starch spray feature 34, a steam spray feature 36, a water spray feature 38, and an auto light 40. Starch spray feature 34 is a button which is connected, by a tube 42, to the compartment 12, as shown in FIGS. 1 and 2. When a user depresses the starch spray feature 34, an extra blast of air is blown through the tube 42 into the compartment 12, forcing a small amount of starch-water combination to be ejected into one or more output tubes 20 and on to one or more exit holes 22, where it will ideally be dispersed onto an item of clothing that is being ironed. When a user depresses the steam spray feature 36, an extra blast of air is blown through the tube 44 into the compartment 10, forcing a small amount of water to be ejected into one or more output tubes 20 and on to one or more exit holes 22, where it will be heated up and dispersed as steam onto an item of clothing that is being ironed.

When a user depresses the water spray feature 38, an extra blast of air is blown through the tube 44 into the compartment 10, forcing a larger amount of water to be ejected into one or more output tubes 20 and on to one or more exit holes 22, where it will be dispersed as water onto an item of clothing that is being ironed. The amount of air that the water spray feature 38 needs to be large enough to force a large enough volume of water through the exit holes 22 quickly enough to make sure that it does not all turn to steam before it is ejected from the exit holes 22. Therefore, the amount of air pumped into the compartment 10 using the water spray feature 38 is greater than the amount of air pumped into the compartment 10 using the steam spray feature 36.

Auto light 40 is designed to turn on when power to the iron 2 is on. Iron 2 is powered by power means 50, which is preferably standard household current. Power means 50 is used through a standard electrical cord 52.

The lower half of the handle 6 has comfort grip 54, which allows an individual to comfortably grasp handle 6 when the iron is in use. Furthermore, iron 2 has a pair of side supports 56 and 58, which can be seen in the three figures. Side supports 56 and 58 are attached to the lower end of the main body and allow iron 2 to be placed upright when not in use.

Iron 2 also has heat indicator dial 60, which is attached to main body 4. Heat indicator dial 60 acts as a resistor between the power means 50 and the face plate 18. By selecting different settings on dial 60, a user can control how hot face plate 18 gets. The different settings on the front of dial 60 are set to indicate temperatures acceptable for different types of clothing, such as wool, linen, silk, nylon, and cotton. The front surface of dial 60 has a plurality of words 62 written on it to indicate these temperatures, with the words 62 including wool, linen, silk, nylon, and cotton.

What I claim as my invention is:

1. An iron comprising:

(a) a main body having two ends, a top end and a bottom end, the main body also having two sides, a front side and a rear side, (b) a handle having two ends, a top end and a bottom end, the top end of the handle attached to the top end of the main body and the bottom end of the handle attached to the bottom end of the main body, (c) a face plate attached to the front side of the main body, (d) a water compartment located within the main body, (e) a volume of water located within the water compartment, (f) a starch compartment located within the main body, (g) a volume of water intermixed with starch located within the starch compartment, (h) a plurality of output tubes, each tube having two ends, a first end and a second end, the first end of each tube connected to either the water compartment or the starch compartment, the second end of each tube connected to the face plate, (i) a plurality of pressure valves, wherein a pressure valve is attached to the first end of each output tube, (j) a starch spray feature connected to the top end of the handle, (k) a first tube connecting the starch spray feature to the starch compartment, (l) a steam spray feature connected to the top end of the handle, (m) a water spray feature connected to the top end of the handle, (n) a second tube connecting the steam spray feature and the water spray feature to the water compartment, (o) power means for providing power to the iron, (p) wherein activating the starch spray feature causes an extra blast of air to be sent through the first tube, forcing a small amount of water intermixed with starch through one or more output tubes onto the face plate, wherein the water intermixed with starch will be dispersed onto an item being ironed, (q) wherein activating the steam spray feature causes an extra blast of air to be sent through the second tube, forcing a small amount of water through one or more output tubes onto the face plate, wherein the water will be turned into steam and be dispersed onto an item being ironed, (r) wherein activating the water spray feature causes an extra blast of air to be sent through the second tube, forcing an amount of water through one or more output tubes onto the face plate, the amount of water dispersed when the water spray feature is activated being larger than when the steam spray feature is activated, wherein the water will be dispersed onto an item being ironed.

2. An iron according to claim 1 wherein the power means for providing power to the iron is standard household current.

3. An iron according to claim 2 wherein the iron further comprises an auto light feature attached to the top end of the handle, the auto light feature turning on whenever the iron is receiving power through the power means.

4. An iron according to claim 3 wherein the iron further comprises:

(a) a water reservoir inlet attached to the top end of the main body, (b) a starch reservoir inlet attached to the top end of the main body, (c) wherein an individual could place an extra volume of water into the main body by depositing the volume of water into the water reservoir inlet, and (d) further wherein an individual could place an extra volume of water intermixed with starch into the main body by depositing the volume of water intermixed with starch into the water reservoir inlet.

5. An iron according to claim 4 wherein the iron further comprises a water level indicator, the water level indicator being located on the water compartment located within the main body and being visible to an individual.

6. An iron according to claim 5 wherein the iron further comprises a starch level indicator, the starch level indicator being located on the starch compartment located within the main body and being visible to an individual.

7. An iron according to claim 6 wherein the iron further comprises a comfort grip, the comfort grip being attached to the lower half of the handle.

8. An iron according to claim 7 wherein the iron further comprises a pair of side supports, the pair of side supports being attached to the lower end of the main body.

9. An iron according to claim 8 wherein the iron further comprises a pair of side supports, the pair of side supports being attached to the lower end of the main body.

10. An iron according to claim 9 wherein the iron further comprises an indicator dial, the indicator dial acting as a resistor between the power means the face plate, wherein the indicator dial has a plurality of settings.

11. An iron according to claim 10 wherein the indicator dial has a plurality of words marked on it to indicate the various settings.

* * * * *